United States Patent [19]

Scamaton

[11] 4,070,970

[45] Jan. 31, 1978

[54] ELECTRO-EXPLOSIVE IGNITERS

[75] Inventor: William Bertram Scamaton, Orpington, England

[73] Assignee: The Secretary of State for Industry in Her Britannic Majesty's Government of the United Kingdom of Great Britain & Northern Ireland, London, England

[21] Appl. No.: 686,065

[22] Filed: May 13, 1976

[30] Foreign Application Priority Data

May 14, 1975 United Kingdom ..... 20469/75

[51] Int. Cl.[2] ..... F42B 3/18

[52] U.S. Cl. ..... 102/28 R

[58] Field of Search ..... 102/28 R, 28 EB, 28 WB

[56] References Cited

U.S. PATENT DOCUMENTS

| | | | |
|---|---|---|---|
| 3,175,492 | 3/1965 | Reyne et al. | 102/28 R |
| 3,374,127 | 3/1968 | Jenner et al. | 102/28 R |

FOREIGN PATENT DOCUMENTS

| | | | |
|---|---|---|---|
| 821,586 | 10/1959 | United Kingdom | 102/28 |

*Primary Examiner*—Verlin R. Pendegrass

*Attorney, Agent, or Firm*—Cameron, Kerkam, Sutton, Stowell & Stowell

[57] ABSTRACT

An electrically initiated igniter having good resistance to accidental low-voltage triggering is disclosed. The igniter comprises a layer of pyrotechnic mixture packed between two initiating electrodes, advantage being taken of the dielectric properties of a selected component of the mixture to provide a high d.c. resistance between the electrodes, which d.c. resistance so limits the current flow through the layer, resulting from an applied electrical stimulus, as to prevent firing of the mixture at all applied voltages which are less than that at which dielectric breakdown of the layer occurs. When fired, the combustion proceeds without shattering and the igniter is particularly suitable for igniting materials requiring non-brisant initiation. A detonator capsule is also disclosed for attachment to the igniter when brisant initiation is required, thus providing an efficient igniter/detonator, the efficiency of which is not impaired by the use of long firing lines, and which may be safely handled and transported because of the separable nature of the two parts.

8 Claims, 2 Drawing Figures

ELECTRO-EXPLOSIVE IGNITERS

Figure 1:
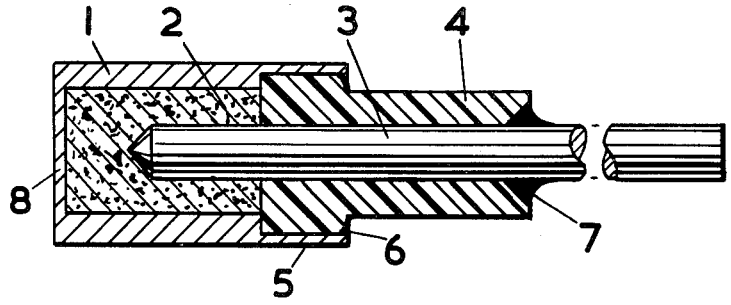

This invention relates to an electrically initiated explosive device for use as a general purpose igniter. The device requires a high voltage firing stimulus and will not readily respond to accidental low voltage triggering. It further provides, in combination with an attachable detonating charge, a safe, high voltage initiated detonator.

In the interests of safety it is desirable that electrically initiated explosive devices should be immune to any accidental triggering stimulus. Conventional igniters are initiated by the heat generated by current flow through a wire bridge of low electrical resistance or through a conducting composition with electrical resistance of up to 2,000 ohms. These 'hot-wire' type devices are generally triggered by voltages derived from thermal batteries or charged capacitors and may well be initiated by voltages of less than 100 volts. Consequently they are sensitive to voltage pulses of an order which can occur accidentally.

Exploding bridgewire detonators with good immunity to low voltage stimuli have been developed in recent years but development of an equivalent slow burning device for general ignition purposes has proved more difficult, mainly because most slow burning compositions will only too readily behave as hot-wire devices and be subject to the low voltage triggering discussed above.

The present invention makes possible the provision of an electrically initiated igniter which is resistant to accidental low voltage triggering, by using the dielectric properties of a component of a selected pyrotechnic mixture to provide an igniter of inherently high d.c. resistance, which d.c. resistance will degrade to a sufficiently low level to permit passage of an adequate firing current through the mixture only when an electrical stimulus of sufficient magnitude to cause electrical breakdown of the dielectric component is applied to the igniter.

According to the present invention an electro-explosive igniter comprises two initiating electrodes separated by a layer of pyrotechnic mixture comprising metal particles intimately and uniformly intermixed with particles of a dielectric material, said mixture including particles of an oxidising agent capable of oxidising the metal particles; said layer having an electrical resistance characteristic such that the density of current flow through the layer resulting from an application of a potential difference across the initiating electrodes is sufficient to initiate an exothermic reaction between the particles of the metal and of the oxidising agent, only when said potential difference is of sufficient magnitude to cause dielectric breakdown of the layer.

The aggregate electrical properties of the mixture are such that current flow through the mixture layer is negligible at all voltages lower than that at which electrical breakdown of the intermixed dielectric particles will occur. Once that level is exceeded current readily flows through the pyrotechnic mixture via the metal particles causing them to heat, some to melting point, and therby starting an exothermic reaction between the metal particles and the oxidising component of the mixture, which reaction quickly gathers momentum becoming violent enough to ignite any other pyrotechnic material in the immediate vicinity.

Preferably the selected oxidising component of the pyrotechnic mixture used in the igniter, itself has sufficiently good dielectric properties to fulfil the necessary pre-breakdown requirement when intimately mixed with metal particles in suitable particle size, proportion and packing density. The oxidising component of the mixture then acts as the dielectric material so that the mixture consists of two components only, with the advantage that as both components contribute wholly to the exothermic reaction once the dielectric strength has broken down, the total heat generated is transmitted fully by the igniter without the internal loss involved in heating the mass of a third intermixed non-contributing component. A preferred two-part mixture is a thermite mixture consisting of powdered aluminium and finely divided cupric oxide, suitable proportions and particle sizes of which are intimately mixed and closely packed to provide a pre-breakdown dc resistance between the two initiating electrodes of at least one megohm, and preferably several.

A convenient configuration for the device is a concentric, cylindrical arrangement in which one electrode may be in the form of a pin held centrally within a cylindrical second electrode by means of an electrically insulating end bush, the annular space between the electrodes being packed with a thermite mixture of suitably high dc resistance. It has been found in practice that a cylindrical configuration is less susceptible to low temperature effects and to vibration effects than other configurations tried.

When fired, although the thermal effect is violent, shattering does not occur and combustion of the device proceeds relatively slowly. Consequently the device is particularly suitable for any application requiring non-brisant initiation.

The device may also be used with advantage to fire an attachable charge of detonating material when brisant initiation is required, such as in demolition or mining. Conventional exploding bridgewire detonators with good immunity to low voltage stimuli are normally fired by the current which is discharged from a charged capacitor when the bridgewire is switched into circuit across the capacitor terminals. Unless the inductance of the bridgewire and its connecting wires is kept low relative to that of the firing capacitor, the discharge current will not be sufficient to initiate explosion and hence it is necessary to restrict the length of the twin firing lines connecting the firing switch to the detonator.

When the present invention is fired from a charged capacitor, the discharge current cannot flow until dielectric breakdown of the device occurs, which event will only take place after the charge on the firing capacitor electrodes has been shared with the initiating electrodes of the igniter. Thus, in effect, the switching function has been transferred from the firing switch to the device itself and the need to restrict the inductance of the interposed connecting wires no longer applies. Consequently much longer firing lines may be employed with the present invention than can be used with conventional detonators.

In addition, the combined igniter/detonator device of the present invention has the very desirable safety feature that the explosive charge can be transported separately from the igniter and the two parts brought together only when required for immediate use.

Figure 2:
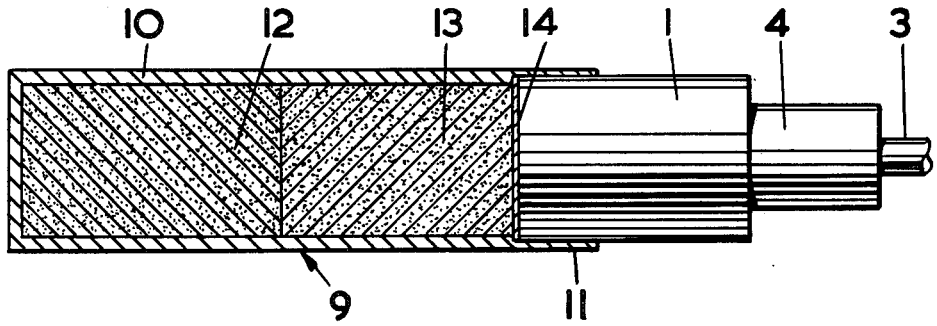

An embodiment of the invention is now described by way of example, with reference to the accompanying drawings of which:

FIG. 1 is a longitudinal section of an electrically initiated igniter illustrating the invention and FIG. 2 is a longitudinal part-section of a device incorporating the igniter shown in FIG. 1 in combination with an attachable further capsule containing a detonating charge.

The device illustrated in FIG. 1 comprises a cylindrical metal capsule 1 containing a closely packed thermite mixture 2 into which is inserted a metal pin 3 centrally mounted in a ceramic bush 4 shaped to fit into a recessed open end 5 of the capsule 1. The ceramic bush is held in position with respect to both the capsule 1 and the pin 3 by solder fillets 6 and 7 respectively around the two external joints. The extent of intrusion of the pin 3 into the capsule 1 is such that the axial distance from the intrusive end of the pin to the closed end of the capsule is no less than the radial distance from the circumference of the pin to the surrounding capsule wall. The end wall 8 of capsule 1 is made thinner than the cylindrical side walls so that it will rupture preferentially when the thermite reaction occurs. Electrical triggering connections (not shown) are made to the capsule 1 and the pin 3.

The preferred thermite mixture 2 used in this embodiment consists of an intimate mixture of aluminium particles and cupric oxide particles in a weight ratio of 1 to 2 respectively, none of said particles being of a grist size any greater than one tenth part of the radial separation of the two electrodes. In one specific example in which the radial separation between the inner electrode and the cylindrical outer electrode is approximately 1mm, the grist size of the constituents used is no greater than 63 microns. Carefully controlled preparation of the mixture is essential for reproducible results and the method employed is as follows.

Aluminium powder of a nominal 10 micron grist size is first passed through a 63 micron BS sieve, dried at 150° C for 1 hour and then tumbled in a wide necked glass container for 30 minutes while cooling. The cupric oxide is first dried at 150° C for 1 hour and then passed through a 63 microns BS sieve. The required weights of each constituent are then thinly spread on separate stainless steel trays and subjected to further heating at 150° C for 3 hours. When the trays have cooled sufficiently to be handled, their contents are transferred into a single wide necked glass container in which they are tumble-mixed together for 30 minutes. A weighed quantity of the resultant mixture is then pressed into each individual igniter capsule, the pressing being controlled so that the mixture occupies a precise volume thus ensuring consistent packing density.

When the capsule is filled with this mixture compressed to an approximate density of 1.4 g/cm$^3$, the firing properties of this embodiment fall within the range of no-fire at 500 volts and, with an available firing current of approximately 250 mA, all-fire at 1,700 volts. The response time is about 1 mS and the device is immune to stray radio frequency signals of up to 4 watts.

The device illustrated in FIG. 1 may be used alone as a non-brisant igniter or in combination with an attachable detonating charge as illustrated in FIG. 2 to provide a safe, electrically fired, long line detonator. An attachable detonating charge 9 comprises a further metal capsule 10 having a recessed open end 11 into which the end wall 8 of the igniter capsule 1 may be inserted. The detonator capsule 10 is packed with a suitable explosive material, in this case PETN (pentaerythritol tetranitrate), a first volume 12 furthest from the igniter being packed with high density PETN and the remaining volume 13 adjacent the igniter being packed with low density PETN. A thin metal membrane 14 is secured across the inner end of the recessed open end 11 after the capsule has been filled, to retain the PETN in position.

Because any applied voltage must exceed a fairly high level before breakdown of the dielectric strength of one of the components of the thermite mixture occurs and consequent exothermic reaction can ensue, the present invention, in both its ignitor and detonator form, is highly resistant to accidental triggering.

The glowing particles of molten copper which are thrown out of the end of the ignitor when the thermite reaction takes place, carry over a fairly large distance and may be used to initiate almost any burning processes.

Used in conjunction with the attachable detonating charge, the ignitor provides an electrically fired detonator capable of use with long firing lines and of great safety in handling because of the separable nature of the two parts.

I claim:

1. An electro-explosive igniter comprising two initiating electrodes separated by a layer of a pyrotechnic mixture of metal particles intimately and uniformly intermixed with particles of an oxidising agent for oxidising the metal particles, said mixture including particles of a dielectric material so selected and distributed in said mixture that said layer has a two-stage electrical resistance characteristic, the first stage having the natural high resistivity of said dielectric material of sufficient magnitude to limit the density of a current flow through said layer upon an application of a potential difference across the initiating electrodes to a level which is insufficient to initiate an exothermic reaction between said metal particles and said oxidising agent when said potential difference is less than a breakdown voltage at which the natural resistivity of said dielectric material degenerates, and the second stage, once said breakdown voltage has been exceeded, being the low resistivity of the resulting dielectrically degenerate mixture, the reduced magnitude of the low resistivity thereafter increasing the density of current flow to initiate said exothermic reaction.

2. An electro-explosive igniter as claimed in claim 1 wherein the dielectric material itself constitutes the oxidising agent.

3. An electro-explosive ignitor as claimed in claim 2 in which the dielectric material is a metal oxide.

4. An electro-explosive igniter as claimed in claim 2 wherein said metal particles are of aluminium and said dielectric material is cupric oxide, aluminium and cupric oxide being present in a weight ratio of approximately 1:2 respectively; said layer having a pre-breakdown d.c. resistance between the two initiating electrodes of at least one megohm.

5. An electro-explosive igniter as claimed in claim 1 wherein one of the electrodes is in the form of a metal pin, centrally and axially supported within a cylindrical metal capsule constituting the other electrode, said capsule and pin being electrically isolated from each other and together defining an annular chamber, which chamber is packed with said pyrotechnic mixture thereby providing a mixture layer of annular configuration.

6. An electro-explosive igniter as claimed in claim 5 wherein the particles all have a grist size less than one tenth part of the radial separation between the two electrodes.

7. An electro-explosive igniter as claimed in claim 6 wherein said layer has a dielectric breakdown voltage within the range of 500 to 1700 volts, the radial separation of the electrodes being approximately 1 mm, the grist size of the particles being no greater than 0.063 mm, and the packing density being within the range 1.3 to 1.5 g/cm$^3$.

8. An electro-explosive igniter as claimed in claim 1, provided with an attachable further capsule containing a charge of detonating material, said further capsule being attachable to the igniter adjacent the pyrotechnic mixture.

* * * * *

UNITED STATES PATENT AND TRADEMARK OFFICE

CERTIFICATE OF CORRECTION

PATENT NO. : 4,070,970

DATED : Jan. 31, 1978

INVENTOR(S) : William Bertram Scamaton

It is certified that error appears in the above-identified patent and that said Letters Patent are hereby corrected as shown below:

Cover page, item [73], "Industry" should read --Defence--.

Signed and Sealed this

*First* Day of *August 1978*

[SEAL]

*Attest:*

RUTH C. MASON
*Attesting Officer*

DONALD W. BANNER
*Commissioner of Patents and Trademarks*